US005290186A

United States Patent [19]

Juranitch

[11] Patent Number: 5,290,186

[45] Date of Patent: Mar. 1, 1994

[54] POULTRY PROCESSING TOOL

[76] Inventor: John Juranitch, P.O. Box 150, Ely, Minn. 55731

[21] Appl. No.: 102

[22] Filed: Jan. 4, 1993

[51] Int. Cl.[5] ..... B26B 13/04

[52] U.S. Cl. ..... 452/149; 30/252; 30/253; 452/64

[58] Field of Search ..... 452/149, 64, 63; 30/194, 341, 253, 145, 196, 244, 246, 248, 252, 253

[56] References Cited

U.S. PATENT DOCUMENTS

| | | | |
|---|---|---|---|
| 326,314 | 9/1885 | McKay | 30/253 |
| 874,516 | 12/1907 | Low | 30/253 |
| 1,186,235 | 6/1916 | Schrade | 30/253 |
| 1,503,372 | 7/1924 | Pacholke | 452/63 |
| 2,497,587 | 2/1960 | Corley | 30/253 |
| 2,512,862 | 6/1950 | Ingwer | 30/332 |
| 2,597,519 | 5/1952 | O'Brien | 30/253 |
| 3,096,581 | 7/1963 | Aapro | 30/261 |
| 3,608,196 | 9/1971 | Wiss | 30/253 |
| 4,089,113 | 5/1978 | Mortiz et al. | 30/253 |
| 4,092,776 | 6/1978 | Ferguson | 30/253 |
| 4,299,030 | 11/1981 | Vickers | 30/261 |
| 4,791,725 | 12/1988 | Amagaya | 30/252 |
| 4,958,435 | 9/1990 | Grubbs et al. | 30/248 |

*Primary Examiner*—Willis Little
*Attorney, Agent, or Firm*—Schroeder & Siegfried

[57] ABSTRACT

A poultry processing device having a pair of substantially flat cooperating side-by-side thin blade-mounting members with a pair of cooperating blades mounted upon and extending forwardly in angled relation from the forward portions thereof, and secured at their rear portions by a transverse pivot pin. An adjustable spring member encircles the pivot pin and has opposite end portions each secured to a different one of the mounting members to urge the blades toward open position. A shiftable pin connects one end of the spring to one of the mounting members and shifts between a variety of positions along the length of one end portion of the spring to vary its torque. The lower blade extends downwardly at about a 45° angle and is longer than the upper blade to compensate for the slicing action of the upper blade which results from the location of the pivot pin. The two mounting members pivot in side-by-side relation within the palm of the hand and a pair of spacer posts extend between the rear portions of the mounting members rearwardly of the pivot pin, one above and one below, which brings the two blades into slightly angled relation. The pivot pin is above and to the rear of the finger grips on the mounting member for the lower blade. The side-by-side assembly of the thin flat mounting members provides a hand-opening and closing action which greatly alleviates stress on the part of the user, as compared to the use of conventional scissors, and greatly minimizes the carpal tunnel syndrome problem currently experienced by so many poultry processors. A thumb rest is carried by the mounting member for the upper blade above and to the right side of that blade so that movement of the thumb is in a plane parallel and immediately adjacent to the palm of the hand of the user rather than at a sharp angle thereto, as is the case in the use of scissors for the same purpose.

20 Claims, 4 Drawing Sheets

POULTRY PROCESSING TOOL

BACKGROUND OF THE INVENTION

The state of the art in poultry processing tools is currently characterized by the use of a conventional scissors to snip away undesirable pieces of cartilage, tendons, broken bones, etc. The lower blade of the conventional scissor, however, is operated by the thumb and the upper blade is controlled by the user's index and middle finger, the latter two (2) fingers extending at substantially right angles to the palm of the user's hand and the thumb extending at a 60°-80° angle to the flat of the palm. This angled relationship is frequently the cause of what is known in the poultry industry as the "carpal tunnel syndrome" which develops in the wrist of most workers who perform this type of work regularly over a span of several years.

The "carpal tunnel syndrome" is evidenced in the area of the carpal tunnel of the user by inflammation, swelling, and pain, and eventually incapacitates the user for that type of work. The carpal tunnel is an area at the inner side of the human wrist through which a nerve runs to the hand and which frequently is a cause of trouble for people who utilize their hands and fingers a great deal, such as pianists, typists, fabric manufacturing workers, knitters, tennis players, poultry processors, etc. Such excess activity may cause tissue to develop in the area of that nerve adjacent the base of the hand. Substantial development of such tissue brings pressure to bear upon that nerve, with resultant inflammation and pain. Relief is obtained primarily by surgery in which the excess tissue is cut away and removed, so as to alleviate the pressure upon the nerve and terminate the pain caused thereby. Such surgery is both expensive and painful and, in addition, incapacitates the worker for a substantial period of time. Moreover, the patient is well-advised to cease that type of employment rather than to risk further complications and redevelopment of more of such objectionable tissue.

In the center of the human wrist, bones and a ligament form a narrow tunnel containing tendons and a major nerve, called the median nerve. The median nerve conducts sensations from the hand, up the arm, to the central nervous system. When the nerve is compressed at the wrist, the hand and fingers are affected adversely. The synovium around the tendons may become thick and sticky due to the normal wear and tear of the aging process or repetitive hand movements, thus pressing the nerve against the tunnel. Various conditions may cause wrist structures to take up extra space in the carpal tunnel. Since bones and ligaments are not compressible, this puts pressure on the nerve, resulting in the symptoms known as "carpal tunnel syndrome".

The "carpal tunnel syndrome" is caused by compression of the median nerve between the substantially inelastic carpal ligament and other structures within the carpal tunnel. The volume of the contents of the tunnel can be increased by organic lesions such as synovitis of the tendon sheathes. Even though no anatomic lesion may be apparent, flattening or even circumferential constriction of the median nerve may be observed during operative action of the ligament. Symptoms of carpal tunnel syndrome occur in the hands and fingers and evidences itself as numbness, tingling, and burning sensations, "pins and needles", and pain in the middle and index fingers and thumb, and sometimes in all five fingers.

Poultry processors normally work with the scissors in wide-open position for maximum purchase in the cutting operation. That position maximizes the angle of the thumb to the palm of the hand and to the area called the carpal tunnel area, thus substantially increasing the likelihood of the development of the objectionable tissue in the carpal tunnel area, as described above. It can be seen that the flesh of the thumb approaches and retracts from the carpal tunnel area as a scissor is manipulated in such a manner and position, to thereby facilitate the development of such undesirable tissue. The repetitive movements of the fingers required of such poultry processors lead to the development of the "carpal tunnel syndrome" in many of them.

My invention is directed toward obviating, or at least greatly minimizing, the tendency for the development of the "carpal tunnel syndrome" by poultry processing workers engaged in such activities.

BRIEF SUMMARY OF THE INVENTION

I have designed a poultry processing tool which is effective in obviating, or at least substantially minimizing, the likelihood that the poultry processor who utilizes that tool will develop "carpal tunnel syndrome". The tool is comprised of a pair of substantially flat, thin blade-mounting members which are pivotally connected at their rear end portions by a transverse pivot pin in a side-by-side relationship. Each of the members mounts a blade in crossed cooperating cutting relation at their adjacent surfaces at their forward ends. The upper blade extends forwardly along the longitudinal line of the elongated mounting member on the right side, and the lower blade extends forwardly and downwardly at about a 45° angle from the upper forward corner of the generally rectangularly shaped mounting member on the left side.

The blade-mounting member on the left side has a loop along its lower portions which are shaped to receive and accommodate the four (4) fingers of the users hand. Slightly above that loop is a slot through which an adjustable spring-anchor extends. One end portion of a spring slidably extends through this anchor, so that the latter can be shifted longitudinally of the wire spring and of the slot to vary the torque provided by the spring. The spring encircles the pivot pin and is anchored at its other end upon the mounting member at the right side.

The blade-mounting member at the right side of the tool is elongated and generally pistol-shaped with the upper blade extending forwardly from the front end of the mounting member parallel to its longitudinal axis. The pivot pin extends through the grip portion of the pistol-shape so that the axis of its pivot is substantially below the cutting edge of the upper blade when the latter is in open position. The pivot pin extends through the mounting member at the left side of the tool opposite the rear end of the slot above the finger-gripped portions and at a level substantially below the upper front corner of the mounting member from which the lower blade extends.

Because of the location of the pivot pin below the cutting edge of the upper blade, the latter has a slicing action in cooperation with the lower blade, which is an action not obtainable in a pair of conventional scissors.

The right side mounting member carries the upper blade in a plane which is tilted inwardly at its cutting edge several degrees relative to the inner surface of the mounting member, the tilting being most prevalent at the tip of the blade. The portions above the upper blade are shaped to conform to a thumb and extend laterally outwardly from the flat inner surface thereof a distance of about 1 inch or less. When the upper blade is depressed by the user closing his hand, the thumb moves downwardly parallel to and just inwardly of the palm of the user's hand.

The fleshy portion of the thumb remains disposed to the right of the upper blade and moves parallel to the palm of the user's hand and the carpal tunnel area of the wrist, thereby obviating the transverse movement of the thumb at a sharp angle to the carpal tunnel area which creates inflammation and swelling at the carpal tunnel area.

The tool is disigned so that the thumb and fleshy part is rested on the top in an imoblized manner, and the motion to operate the tool is provided by the four remaining fingers. This will decrease stress in carpal tunnel area if only the four fingers on the lower left side of the tool are used. It would be easy to instruct the user, especially a new employee, to use the tool in this manner.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE DRAWINGS

Figure 1:
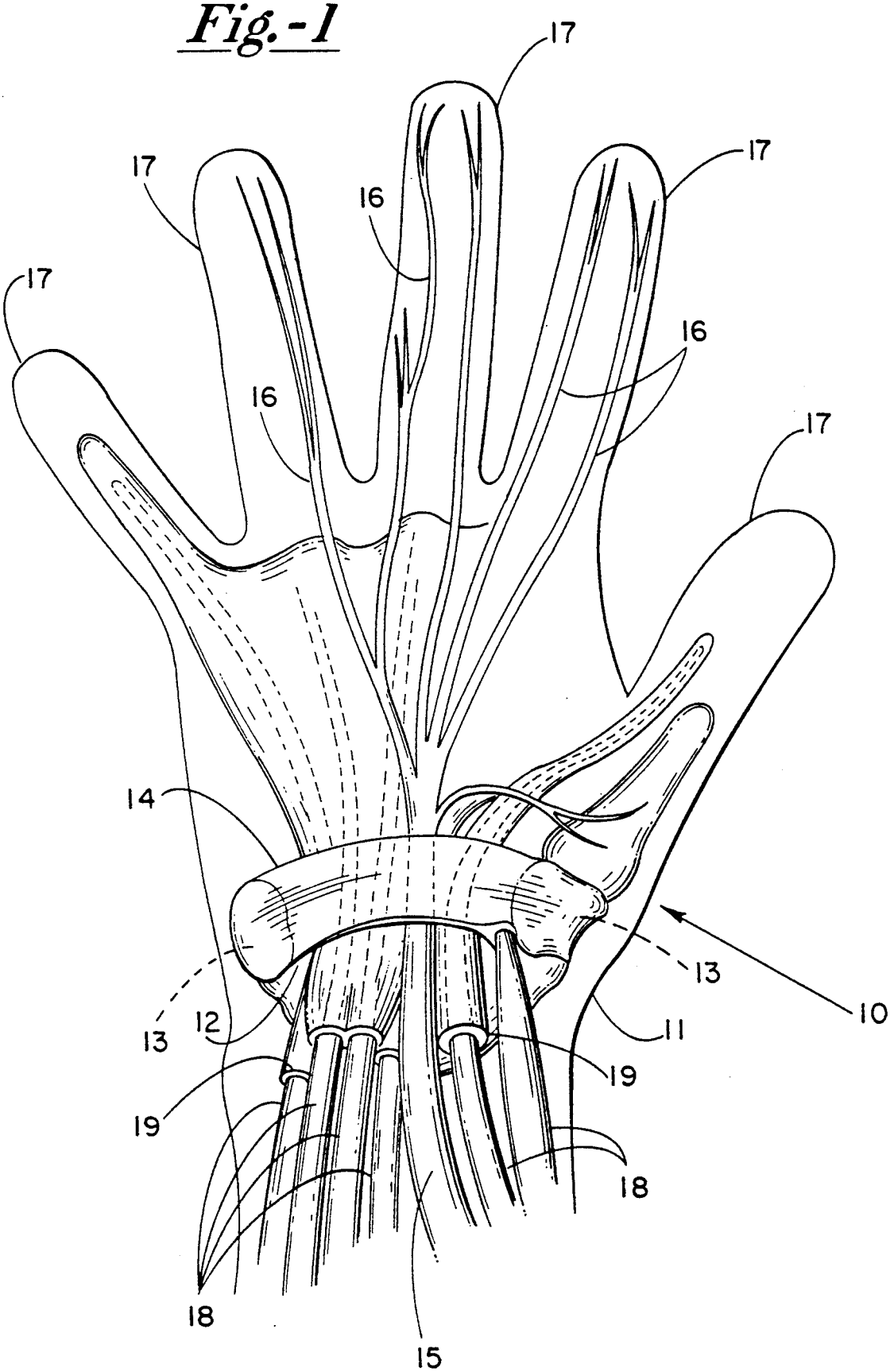
FIG. 1 is a diagrammatic view of the interior of a human hand, illustrating the carpal tunnel, nerves, tendons, and associated elements.

FIG. 1 illustrates a human hand 10 and wrist area 11. The carpal tunnel area is identified with the numeral 12. A U-shaped cluster of eight bones 13, called the carpal bones, is located at the base of the palm and forms the hard, rigid floor and the two sides of the tunnel. A strong ligament 14 lies across the arch of the carpal bones 13, forming the roof of the tunnel.

Extending through the tunnel 12 is a main nerve called the median nerve 15, the many nerve endings 16 extending outwardly into the various fingers 17. It is this median nerve 15 which is subjected to pressures originating from a variety of sources to cause what is known as the "carpal tunnel syndrome". Nine (9) separate flexor tendons 18 extend through the tunnel 12 along opposite sides of the median nerve 15 to the various fingers 17. As shown each of the tendons 18 have a lubricating outer lining 19 which allows the tendons to slide back and forth through the tunnel 12 as the wrist and the fingers are used. The motor branch 20 of the median nerve 15 controls the muscle surrounding the thumb. Damage thereto affects the hands ability to grasp items of various sizes.

When the median nerve 15 is compressed, numbness, tingling, "pins and needles", burning sensations and pain in the middle and index fingers and thumb are experienced. Certain repetitive hand activities are more likely to create the "carpal tunnel syndrome" than others. It has been found that flexing or twisting of the wrist and gripping, grasping, or lifting with the thumb and index fingers puts stress on the wrist and causes inflammation and pressure to build up upon the median nerve, thereby creating the above symptoms. When the internal pressure within the tunnel becomes sufficiently intense, surgery is required to relieve the pressure; thickened synovial tissue 19 which surrounds the tendons, may also be removed.

Figure 2:
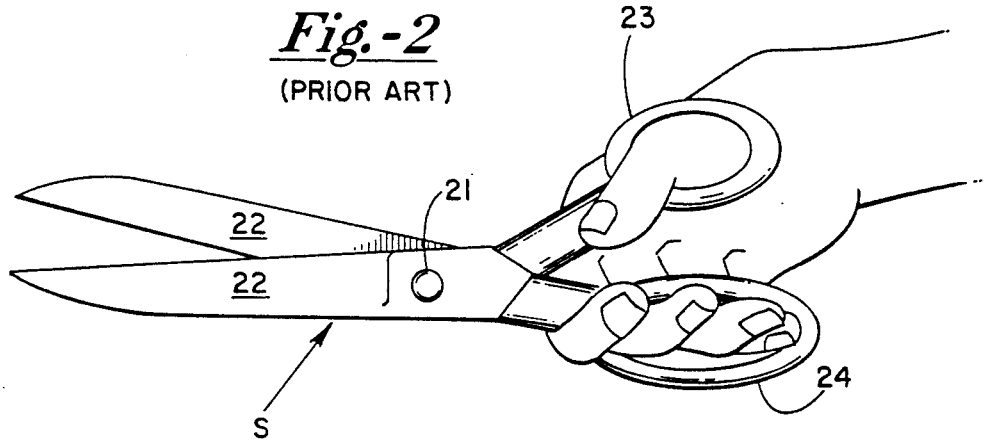
Fig.-2 (PRIOR ART)
FIG. 2 is an elevational view of a pair of scissors which constitutes the prior art.

FIG. 2 shows the prior art as currently in use in the poultry processing industry. It is the old and conventional shears in which the pivot pin 21 is located between the cutting blades 22 and the rings or loop 23 and 24, by means of which the scissors is utilized. As shown the thumb extends through the loop 23 and the remaining fingers extend into and around the loop 24 at the outer knuckle. Note that the thumb extends at 65°–90° to the palm of the hand, which places an undue burden upon the tendons which operate the thumb.

Figure 3:
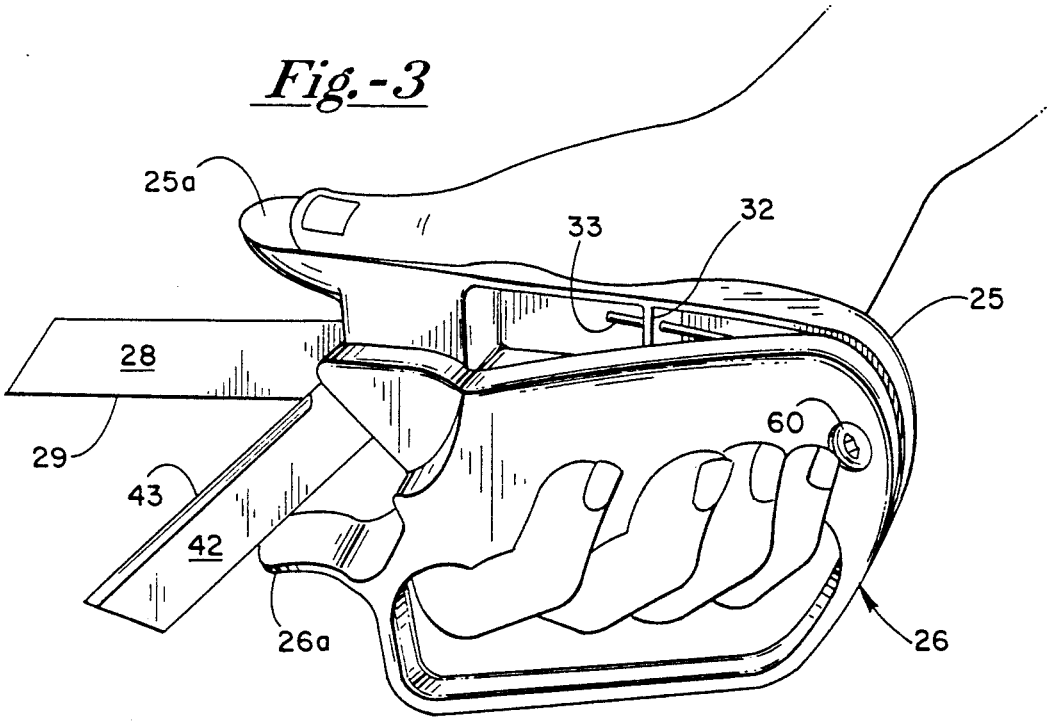
FIG. 3 is a perspective view of my new tool, as viewed from the left side, with the blade mounting members shown as gripped by the user.
Figure 4:
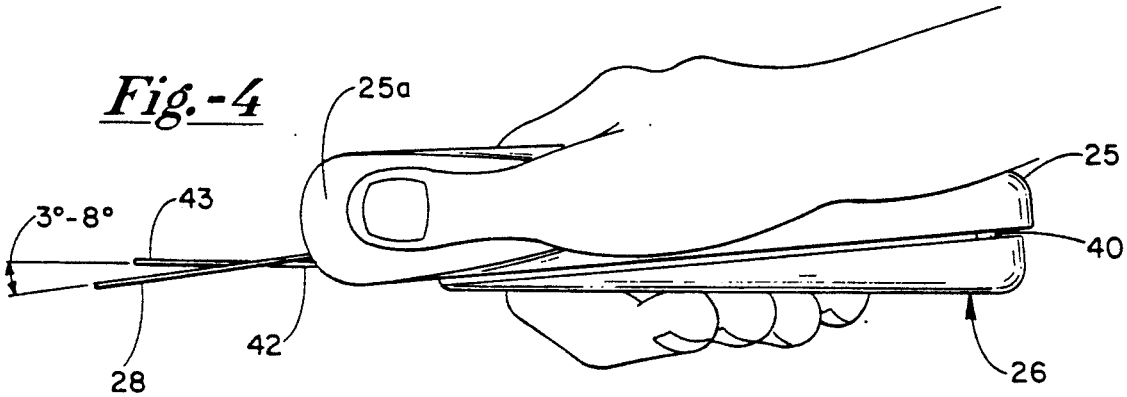
FIG. 4 is a top plan view of my new tool, shown as gripped by the user.

FIG. 3 shows my poultry processing tool which is constructed to alleviate many of the problems experienced by workers utilizing tools such as that shown in FIG. 2. It is comprised principally of a pair of generally flat thin blade-mounting panels 25 and 26 which are pivotally connected by a pivot pin at their rear ends, so that they may pivot past each other in registering relation, as best shown in FIG. 4.

Figure 7:
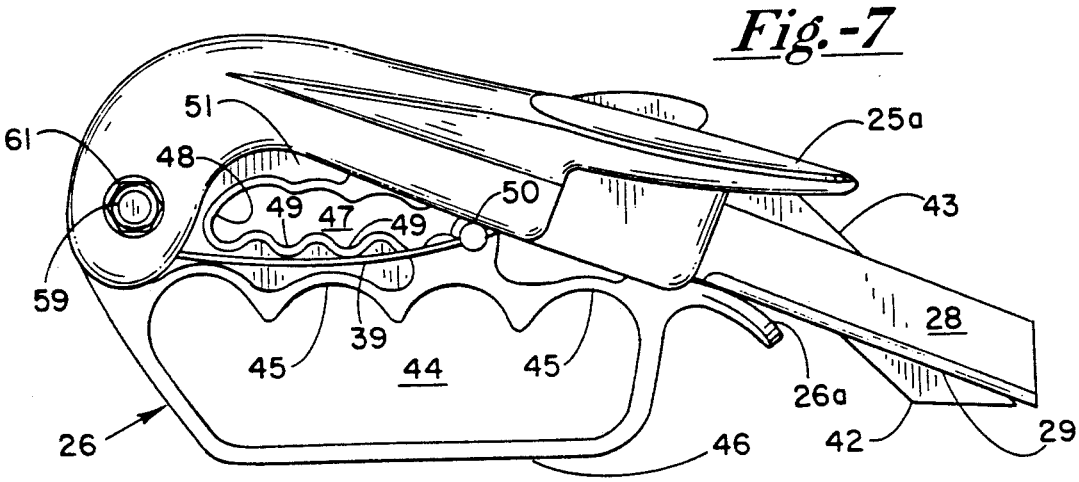
FIG. 7 is a right side elevational view of my new tool, in closed position.
Figure 8:
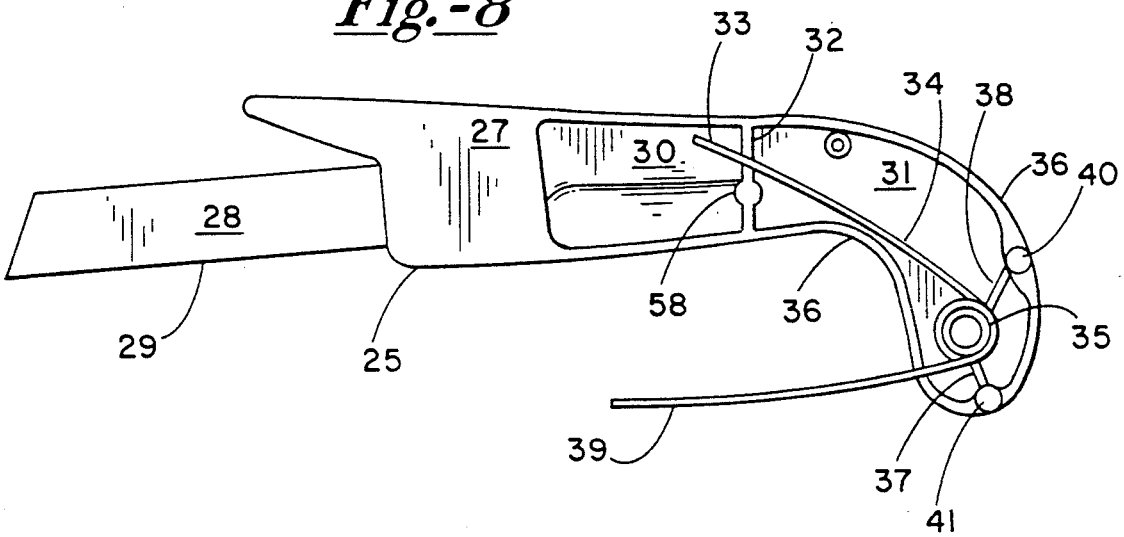
FIG. 8 is a side elevational view of the blade mounting member on the right side of my took, viewed from the left, with the blade mounting member on the left side removed.
Figure 9:
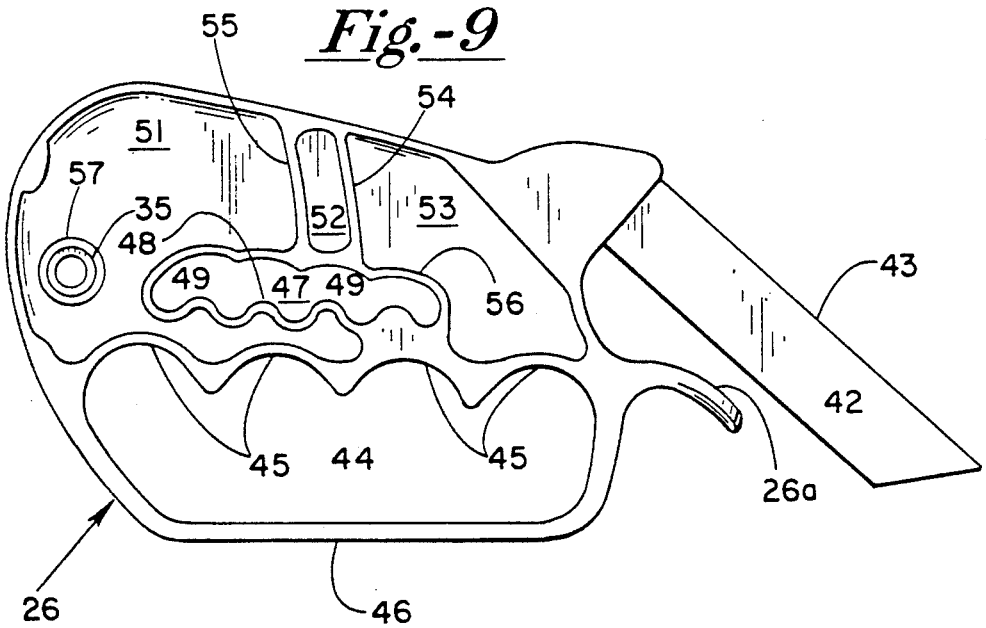
FIG. 9 is a side elevational view of the blade mounting member on the left side of my took, viewed from the right, with the blade mounting member on the right side removed.

The construction and shape of the two panels 25 and 26 can best be seen in FIGS. 8 and 9. The right hand blade-mounting member 25 is elongated and generally pistol-shaped. It has a flat surface 27 which moves past a corresponding blade-mounting section of the left hand panel 26, as the blades are moved between open position, shown in FIGS. 5 and 6 and closed position shown in FIG. 7, the latter being reached at the end of the cutting operation. The blade-mounting member 25 is preferably made of a plastic material and its blade 28 about which it is molded extends forwardly therefrom. The beveled cutting edge 29 of the blade extends generally parallel to the length of elongated thin panel 25.

The rear portion of the panel 25 is somewhat hollowed at its inner surface as at areas 30 and 31, which are separated by a narrow transverse anchor wall 32. This anchor wall has an opening (not shown) therethrough to accommodate end portion 33 of a wire spring 34 which extends through said opening, as best shown in FIG. 8.

Carried centrally of the handle-like portion of the pistol shaped blade-mounting member and extending transversely outwardly from the bottom of the hollowed area 31 is a plastic pivot tube 35. This tube 35 is mounted within a transverse opening provided therefor in the handle and extends outwardly so as to terminate in a corresponding opening in the rear end portion of the other blade-mounting member 26 as shown in FIG. 8. Edges 36 define the hollow areas 30 and 31. Transverse strengthening walls 37 and 38 extend from the annular wall (not shown) which defines the opening in which pivot tube 35 is mounted to the edge portions which define hollowed area 31.

Figure 5:
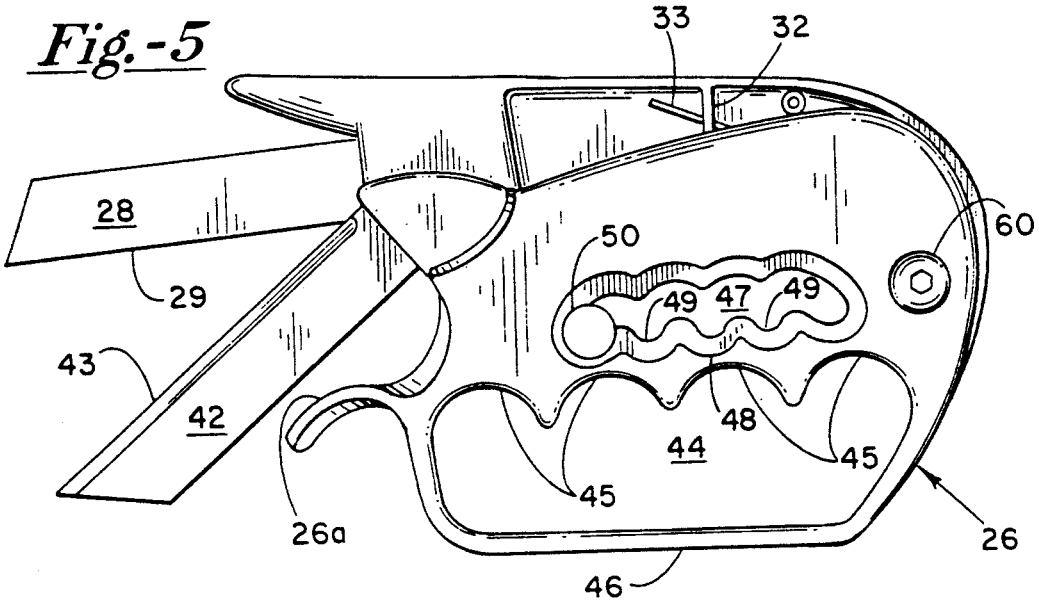
FIG. 5 is a left side elevational view of my new tool, in open position.
Figure 6:
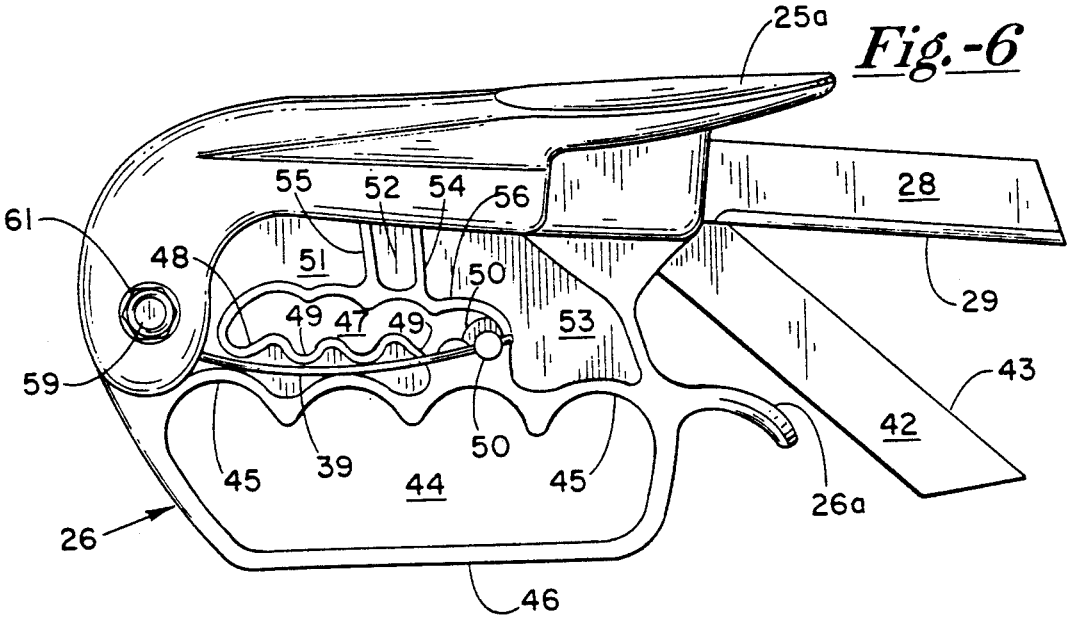
FIG. 6 is a right side elevational view of my new tool, in open position.

Wire spring 34 encircles pivot tube 35 and its opposite end portion 39 extends forwardly therefrom and is adjustably anchored upon opposing flat blade-mounting member 26 while under only slight tension while the blades are in open position. The tension applied to the blades is increased as end portions 33 and 39 are moved toward each other, upon the blades being moved from open position, as shown in FIGS. 2, 5, and 6, to closed position, shown in FIG. 7.

Short transverse spacer posts 40 and 41 are carried by the edge portions 36 which define the hollowed area 31. These spacer posts 40 and 41 are located rearwardly of pivot tube 35, post 40 being above pivot tube 35 and post 41 being below pivot tube 35. These posts extend between said edge portions and corresponding edge portions of blade mounting panel 26, so as to maintain the rear end portions of the blade-mounting panels in spaced relation and thereby cause the forward end portions of said panels to extend slightly inwardly toward each other.

FIG. 9 shows the interior of left blade mounting panel 26. This thin plastic panel is generally rectangular in shape and mounts lower blade 42 so that its beveled cutting edge 43 extends downwardly from the upper forward corner of the panel at about a 45° angle. A downwardly curved lip 26*a* extends forwardly from the medial front edge portions of the panel and serves as a stop or abutment which limits the extent of downward movement of the upper blade 28, as shown in FIG. 7. The finger tab also serves as another position the tool can be used, so as to rest the hand. It also provides more accuracy in cutting, as well as more force.

The lower half of blade-mounting panel 26 has an opening 44 extending therethrough and designed, as at 45, to conform to the shape of the fingers of the user's hand. The opening 44 is defined by a rib 46 which is generally rectangular in cross-sectional shape.

Immediately above the opening 44 is an elongated narrow opening 47 the lower wall 48 of which is defined by a plurality of concavities 49 which are designed to accommodate an anchor pin 50 which can be shifted between the various concavities to adjust tension on the spring. Anchor pin 50 has a transverse opening in its outer end through which free end 39 of spring 34 extends. Thus, as anchor pin 50 is shifted along the length of end portion 39, the tension which is imposed upon spring 34 is varied, as desired.

Areas 51, 52, and 53 of panel 26 are cavities separated by strengthening walls 54 and 55 and wall 56, which defines opening 47, is upstanding from the bottoms of said cavities.

At the rear of cavity 51, there is an annular shoulder 57 which extends outwardly from the bottom of that cavity and accepts, in snug encircling relation, the other end of pivot tube 35. Spring 34 encircles pivot tube 35 between the two (2) blade mounting members, as best shown in FIG. 8.

Pin 58 which is carried by wall 32 of panel 25 (see FIG. 8) extends into opening 52 of panel 26 and swings between the ends thereof, as blades 28 and 42 are moved between open and closed positions.

Connector pin 59 has an Allen head 60 at one end and a threaded portion (not shown) at the other, the latter being threaded into nut 61 at the opposite side of blade mounting panel 25, as shown in FIG. 6. Connector pin 59 holds the two (2) blade-mounting panels in registering relation as they pivot about pivot tube 35 and also, in cooperation with spacer posts 40 and 41, holds the blades in cooperative cutting relation.

FIG. 3 shows the blades 28 and 42 in slightly exaggerated crossed relation which is the result of the presence of spacer pins 40 and 41 at the rear end of the mounting panels. In addition blade 42 is mounted in panel 26 so that its longitudinal axis extends at an angle of 3°–8°, preferably at 5°, to the longitudinal axis of the blade 28.

Also as shown in FIG. 3, the upper surface of the mounting panel 25 is flattened as at to provide a comfortable and effective bearing surface upon which the users thumb may rest. Note that when the tool is being used, the tool extends flat within the palm of the users hand with the fingers extending therethrough to the interphalangeal knuckles, as viewed in FIG. 2. Note also that the pressure is applied by moving the thumb downward in a line parallel to and, immediately adjacent the palm of the user's hand, and that the user can relax his hand while the blades are brought back to open position by spring 34. This is in contrast to the use of a scissor where the user must utilize muscles running to the thumb to bring the scissor blades back to open position and the thumb must be moved at an angle approximately 60°–80° to the palm of the hand and to the wrist.

The average poultry user makes 35 snips per minute, or 2100 snips per hour. Such continuous, repetitive, and rapid movements place a great deal of stress upon the wrist and the tendons and eventually lead almost inevitably to experiencing the "carpal tunnel syndrome". My tool effectively reduces the development of these problems. We believe this is occasioned by the slicing action between the blades which greatly facilitates the cutting operation, since a slicing action in which the cutting edge is drawn across the surface being cut is well known to greatly reduce the pressure which is required. In my new tool, the upper blade 28 and its cutting edge 29 is moved lengthwise of the cutting edge 43 of the blade 42 as the blades move from open to closed or cutting position. This cutting action is the result of the location of the axis of pivot of the two (2) blades being located at the rear of the blade-mounting panels and below the cutting edge 29 of the upper blade 28, as well as below the point where the blades cross at the beginning of the cutting operation.

It should also be noted that the longitudinal axis of the blades 28 and 42 extend at an angle of 3°–8° relative to each other. This maintains the blades in optimum cutting relation to each other, particularly in view of the use of the two (2) spacer posts at the rear which permits the two (2) blades to be separated manually, if desired, and assures that the blades are not urged against each other with sufficient pressure to cause an undue wearing and dulling effect. Instead, they bear against each other with only slight pressure, causing them to aid in maintaining a sharp edge along cutting edges 29 and 43.

It will be noted that the lower blade 42 is longer than the upper blade 28. This is necessary because of the sweeping, slicing action of the upper blade as a result of the axis of pivot of the two (2) blades being disposed below the longitudinal axis of the cutting edge 29 of the upper blade.

Since most travel takes place in the fingers, it is important that in the use of my tool, the fleshy part of the thumb bears against the top part of the mounting panel of the upper blade and moves a minimum of distance and along a plane parallel to and immediately adjacent to the palm of the hand. Thus the extent of movement of the thumb is minimized and, at the same time, the movement is in a more beneficial plane. Operators who utilize scissors move their fingers 2½ inches between open and cut positions—my tool requires only ¾-1.0 inches of movement of the fingers.

When in open position, the blades 28 and 42 are in slightly spaced relation. As they move toward cutting position, however, they quickly engage each other and move past each other in a slightly pressurized slicing action, as a result of the natural action of the hand, and the design of the tool.

The use of my new tool requires movement of the fleshy part of the thumb and hand against the mounting of the upper blade. As the lower blade is moved, it is moved by a squeezing action of the hand. Thus the cutting operation requires only the opening and closing of the hand. Emphasis is placed upon the closing of the fingers rather than upon pressure applied by the thumb. All of the fingers are used to supply the needed pressure, rather than only two or three, and the middle or interphalangeal knuckles are utilized upon the tool instead of the outer knuckles which are used when a scissor is employed.

The tool is designed so that the fingers clostest to the thumb apply the most pressure and travel. In a conventional scissor, it is the opposite.

It will, of course, be understood that various changes may be made in the form, details, arrangement and proportions of the parts without departing from the scope of the invention which consists of the matter shown and described herein and set forth in the appended claims.

I claim:

1. A poultry processing device comprising:

(a) a pair of upper and lower elongated cutting blades movable past each other between open and closed positions, each of said blades having a cutting edge extending in crossed cooperative cutting relation when in open position;

(b) a pair of blade-mounting members extending in side-by-side relation and having forward and rearward end portions and each mounting one of said blades upon its forward end portion so as to extend forwardly therefrom in crossed cutting relation to each other;

(c) a pivot member pivotally connecting said blade-mounting members at their rearward end portions in said side-by-side relation at a point below the said cutting edge of said upper blade to enable the same to pivot relative to each other and thereby move said blades with a slicing action relative to each other between said open and closed positions; and (d) spring means extending between said blade-mounting members and urging them to move said blades toward said open position.

2. The structure defined in claim 1, wherein said lower blade extends downwardly and forwardly from the forward end portion of one of said blade-mounting members.

3. The structure defined in claim 1, wherein said spring means is carried by said pivot member in encircled relation.

4. The structure defined in claim 1, wherein said spring means has opposite end portions each of which is anchored on one of said blade-mounting members.

5. The structure defined in claim 1, and a movable anchor member carried by one of said blade-mounting members and being connected to and shiftable longitudinally of said spring means to adjust the torque applied by said spring means to said blade-mounting members.

6. The structure defined in claim 1, and adjustment means carried by said spring means for adjusting the torque applied by said spring means upon said blade-mounting members.

7. The structure defined in claim 1, wherein at least one of said blade-mounting members extends generally in a flat plane and includes a hand-conforming grip through which fingers of an operator may extend with the interphalangeal knuckles of the fingers extending in the general plane of said blade member.

8. The structure defined in claim 1, wherein one of said blade-mounting members is elongated and the cutting blade-mounted thereon extends forwardly therefrom along and parallel to the longitudinal axis thereof.

9. The structure defined in claim 1, wherein the said blade carried by one of said blade-mounting members extends at a slight angle out of the general plane of said blade-mounting member and at a slight angle to the said blade carried by the other of said blade-mounting members.

10. The structure defined in claim 9, wherein said first mentioned blade extends at an angle of about 3°-8° out of the plane of said blade-mounting member and across the plane of the other of said blades.

11. The structure defined in claim 9, wherein said first mentioned blade extends at an angle of approximately five degrees (5°) out of the plane of said blade-mounting member.

12. The structure defined in claim 7, wherein said pivot member has an axis of pivot disposed rearwardly of said grip.

13. The structure defined in claim 7, wherein said pivot member has an axis of pivot disposed rearwardly of and above said grip.

14. The structure defined in claim 1, wherein one of said blade-mounting members is elongated and has an upwardly facing thumb-conforming surface disposed above and generally parallel to the cutting edge of said blade carried thereby.

15. The structure defined in claim 1, wherein said pivot member is located substantially below the cutting edge of said upper cutting blade.

16. The structure defined in claim 1, and spacer means located rearwardly of the axis of said pivot member and extending between the rear end portions of said blade-mounting members, and maintaining said rear end portions in slightly spaced relation as they pivot relative to each other.

17. The structure defined in claim 1, wherein said blade-mounting members have substantially flat opposed surfaces bearing against each other as they pivot, and spacer means located rearwardly of the axis of said pivot member, and extending between the rear end portions of said blade-mounting members and maintaining said rear end portions in slightly spaced relation as they pivot relative to each other.

18. The structure defined in claim 1, and a pair of separate spacer elements carried by the rear end portions of said blade-mounting members and located along a line disposed rearwardly of the axis of said pivot member, and maintaining said rear end portions of said blade-mounting members in slightly spaced relation as they pivot relative to each other.

19. The structure defined in claim 18, wherein one of said spacer elements is located above the axis of said pivot member, and the other of said spacer elements is located below the axis of said pivot member.

20. A poultry-processing device comprising:

(a) a pair of cooperative bevel-edged pivotally mounted cutting blades being pivotable past each other between open and closed positions in cooperative cutting relation;

(b) first blade-mounting means supporting one of said cutting blades in forwardly extending relation and constructed and arranged to be gripped by the fingers of a user to move said supported blade toward the other of said blades;

(c) second blade-mounting means supporting the other of said cutting blades and constructed and arranged to be engaged by the thumb of the user to move the other of said blades toward and past its said cooperating blade;

(d) pivot means pivotally connecting said first and second blade-mounting means for such movement of said blades past each other in cooperative cutting relationship, said pivot means pivotally connecting said first and second blade-mounting means rearwardly of said hand-gripped portions of said first blade-mounting means; and (e) spring means extending between said first and second blade-mounting means and constantly urging said cutting blades away from each other toward open position.

* * * * *

UNITED STATES PATENT AND TRADEMARK OFFICE

CERTIFICATE OF CORRECTION

PATENT NO. : 5,290,186

DATED : March 1, 1994

INVENTOR(S) : John Juranitch

It is certified that error appears in the above-indentified patent and that said Letters Patent is hereby corrected as shown below:

Col. 3, line 17, "disigned" should be --designed--.

Col. 3, line 18, "imoblized" should be --immobilized--.

Col. 3, line 50, "took" should be --tool--.

Col. 3, line 54, "took" should be --tool--.

Col. 7, line 34, "clostest" should be --closest--.

Signed and Sealed this

Twenty-third Day of August, 1994

*Attest:*

Bruce Lehman

BRUCE LEHMAN

*Attesting Officer*

*Commissioner of Patents and Trademarks*